US007959479B2

(12) United States Patent
Ryuman et al.

(10) Patent No.: US 7,959,479 B2
(45) Date of Patent: Jun. 14, 2011

(54) BOAT PROPULSION SYSTEM AND BOAT INCLUDING THE SAME AND BOAT CONTROL DEVICE AND BOAT CONTROL METHOD

(75) Inventors: Mitsuhiro Ryuman, Shizuoka (JP); Hirotaka Kaji, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 183 days.

(21) Appl. No.: 12/341,297

(22) Filed: Dec. 22, 2008

(65) Prior Publication Data

US 2009/0170387 A1 Jul. 2, 2009

(30) Foreign Application Priority Data

Dec. 27, 2007 (JP) ..... 2007-337197

(51) Int. Cl.
*B63H 21/22* (2006.01)
*B63H 23/00* (2006.01)

(52) U.S. Cl. ..... 440/1

(58) Field of Classification Search ..... 440/1, 84, 440/87, 61 R, 61 C, 61 T, 61 G; 701/21
See application file for complete search history.

(56) References Cited

U.S. PATENT DOCUMENTS

| | | | | |
|---|---|---|---|---|
| 5,711,742 | A | 1/1998 | Leinonen et al. | |
| 6,336,833 | B1 * | 1/2002 | Rheault et al. | 440/1 |
| 6,428,371 | B1 * | 8/2002 | Michel et al. | 440/38 |
| 6,855,020 | B2 * | 2/2005 | Kaji | 440/84 |
| 7,416,458 | B2 * | 8/2008 | Suemori et al. | 440/53 |

* cited by examiner

*Primary Examiner* — Daniel V Venne
(74) *Attorney, Agent, or Firm* — Keating & Bennett, LLP

(57) ABSTRACT

A boat propulsion system includes a control section, a thrust calculation section, a thrust generating unit, a thrust detection section, and a control section. An operating amount is input to the control lever by operation of an operator. An accelerator detector detects the input operating amount of the control lever. The thrust calculation section calculates a thrust intended to be generated from the operating amount of the control lever to output a calculated thrust. The thrust generating unit generates a thrust. The thrust detection section detects a thrust actually generated on the thrust generating unit to output it as an actual thrust. The control section controls an output of the thrust generating unit so that the actual thrust approaches the calculated thrust.

17 Claims, 14 Drawing Sheets

BOAT PROPULSION SYSTEM AND BOAT INCLUDING THE SAME AND BOAT CONTROL DEVICE AND BOAT CONTROL METHOD

BACKGROUND OF THE INVENTION

1. Field of the Invention

The present invention relates to a boat propulsion system and a boat including the same, and also relates to a boat control device and a boat control method.

2. Description of the Related Art

Conventionally, various boat propulsion systems such as an inboard motor, an outboard motor, a so called stern drive, etc. are known. As disclosed in JP-A-Hei 9-104396, for example, an output of the boat propulsion system is generally controlled based on a rotational speed of an engine or a propeller. In particular, the output of the boat propulsion system is generally controlled such that the rotational speed of the engine or the propeller follows the rotational speed corresponding to an operating amount of a control lever controlled by an operator.

There are some cases in which, even if the rotational speed of the engine or the propeller is the same as the rotational speed corresponding to an operating amount of a control lever controlled by an operator, an actual thrust obtained by the boat propulsion system differs under different sea conditions. Accordingly, when the rotational speed of the engine or the propeller is controlled to follow the rotational speed corresponding to the operating amount of the control lever, the obtained thrust may differ for the same operating amount of the control lever.

SUMMARY OF THE INVENTION

In view of the foregoing problems, preferred embodiments of the present invention provide a boat propulsion system, a boat including a boat propulsion system, a boat control device and a boat control method that stabilize a correlation between the operating amount of the control lever and the obtained thrust.

A boat propulsion system according to a preferred embodiment of the present invention includes a control lever, an accelerator detector, a thrust calculation section, a thrust generating unit, a thrust detection section, and a control section. An operating amount is input to the control lever by operation of an operator. The accelerator detector detects the input operating amount. The thrust calculation section calculates a thrust intended to be generated from the operating amount of the control lever. The thrust calculation section outputs the calculated thrust as a calculated thrust. The thrust generating unit generates a thrust. The thrust detection section detects a thrust actually generated on the thrust generating unit. The thrust detection section outputs the detected thrust as an actual thrust. The control section controls an output of the thrust generating unit so that the actual thrust approaches the calculated thrust.

A boat according to a preferred embodiment of the present invention includes a boat propulsion system according to the above-described preferred embodiment of the present invention.

A boat control device according to a preferred embodiment of the present invention includes including a control lever, an accelerator detector, and a plurality of boat propulsion systems. An operating amount is input to the control lever by operation of an operator. The accelerator detector detects the input operating amount of the control lever. Each boat propulsion system includes a thrust generating unit and a detection section. The thrust generating unit generates a thrust. The detection section detects a thrust-correlated force actually generated on the thrust generating unit.

The boat control device according to a preferred embodiment of the present invention includes a thrust calculation section, a thrust conversion section, and a control section. The thrust calculation section calculates a thrust intended to be generated on each boat propulsion system from the operating amount of the control lever. The thrust calculation section outputs the calculated thrust as a calculated thrust for each boat propulsion system. The thrust conversion section calculates a thrust actually generated on each boat propulsion system based on a thrust-correlated force. The thrust calculation section outputs the calculated thrust as an actual thrust for each boat propulsion system. In each boat propulsion system, the control section controls an output of the thrust generating unit of each boat propulsion system so that the actual thrust approaches the calculated thrust.

A boat control method according to yet another preferred embodiment of the present invention performs control using a control lever, an accelerator detector, and a plurality of boat propulsion systems. An operating amount is input to the control lever by operation of an operator. The accelerator detector detects the input operating amount of the control lever. Each boat propulsion system includes a thrust generating unit and a detection section. The thrust generating unit generates a thrust. The detection section detects a thrust-correlated force actually generated on the thrust generating unit.

The boat control method according to a preferred embodiment of the present invention calculates a thrust intended to be generated on each boat propulsion system from the operating amount of the control lever, calculates an actual thrust actually generated on each boat propulsion system based on the thrust-correlated force, and controls an output of the thrust generating unit of each boat propulsion system in each boat propulsion system so that the actual thrust approaches the calculated thrust.

According to various preferred embodiments of the present invention, it is possible to stabilize a correlation between an operating amount of the control lever and an obtained thrust.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Hereinafter, preferred embodiments of the present invention will be described. However, the present invention is not limited to the following preferred embodiments.

First Preferred Embodiment

Figure 1:
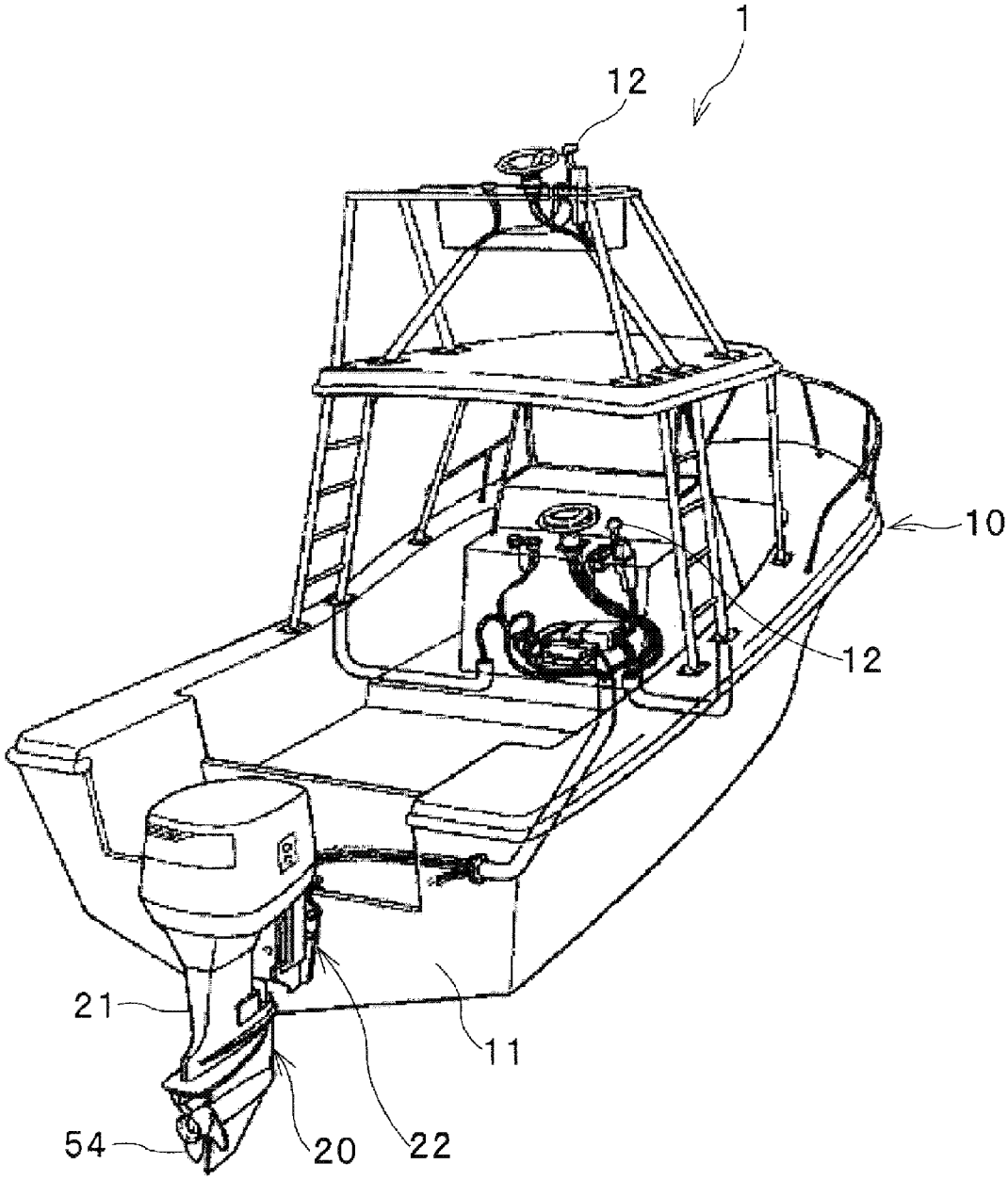
FIG. 1 is a perspective view from rearward of a boat according to a first preferred embodiment of the present invention.
Figure 2:
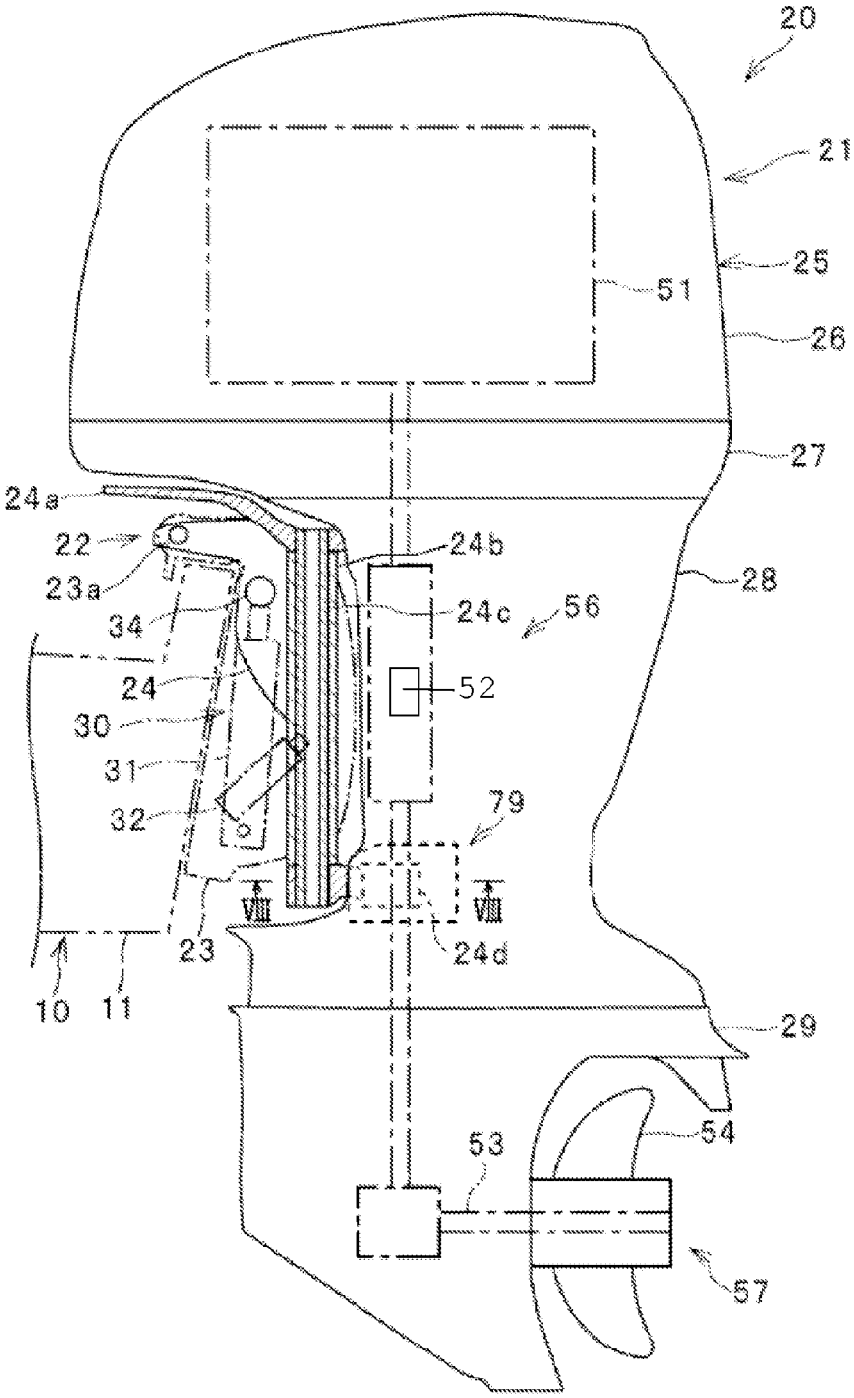
FIG. 2 is a schematic side view of an outboard motor mounted at a stern.

FIG. 1 is a perspective view of a boat 1 according to a first preferred embodiment as viewed from obliquely rearward. FIG. 2 is a schematic side view of an outboard motor 20. As shown in FIG. 1, the boat 1 includes a hull 10 and the outboard motor 20 as a boat propulsion system.

The boat 1 is provided with a control lever 12. The control lever 12 is operated by an operator for shifting gears and accelerating the boat. Specifically, the operator shifts the control lever 12 into a neutral position to change the shift position to be neutral. Accordingly, driving of a propeller 54 of the outboard motor 20 is stopped.

When the operator shifts the control lever 12 into a forward position, the shift position is changed to be forward. Accordingly, a forward thrust is generated in the outboard motor 20. In the forward position, the acceleration increases as the operating amount of the control lever 12 increases. The forward thrust generated in the outboard motor 20 also increases as the operating amount increases.

In contrast, when the operator shifts the control lever 12 into a reverse position, the shift position is changed to be in reverse. Accordingly, a reverse thrust is generated in the outboard motor 20. In the reverse position, the acceleration increases as the operating amount of the control lever 12 increases. The reverse thrust generated in the outboard motor 20 also increases as the operating amount increases.

Outboard Motor 20

As shown in FIGS. 1 and 2, the outboard motor 20 is mounted at a stern 11 of the hull 10. As shown FIG. 2, the outboard motor 20 includes an outboard motor body 21 as a propulsion unit, a bracket 22, and a tilt and trim mechanism 30. The outboard motor body 21 is fixed to the stern 11 via the bracket 22. In this preferred embodiment, an example in which the outboard motor 20 is mounted at the stern 11 will be described. However, the mounting position of the outboard motor 20 is not limited to the stern 11. The outboard motor 20 may be mounted at any portion on the hull 10.

Bracket 22

The bracket 22 includes a pair of left and right mount brackets 23 and a swivel bracket 24. The mount bracket 23 is fixed to the hull 10 with a screw (not shown).

The swivel bracket 24 is disposed between the pair of the left and the right mount brackets 23. The swivel bracket 24 is supported by the mount brackets 23 via a turning shaft 23*a*. The swivel bracket 24 is swingably supported around the turning shaft 23*a* in a vertical direction. The outboard motor body 21 is attached to the swivel bracket 24 preferably via rubber mounts at two locations, an upper mount (not shown) and a lower mount 79, which will be described in detail below.

The swivel bracket includes a steering bracket 24*a* and a cylindrical turning shaft sleeve 24*b*. A turning shaft 24*c* is rotatably inserted in the turning shaft sleeve 24*b*. The steering bracket 24*a* is fixed to the turning shaft 24*c*. Accordingly, the turning shaft 24*c* can be rotated by swinging the steering bracket 24*a* to the left and right.

A rear end of the steering bracket 24*a* is attached to an upper casing 28 of the outboard motor body 21 via a rubber damper (not shown). The rubber damper and the rear end of the steering bracket 24*a* form the upper mount. A lower end of the turning shaft 24*c* is also attached to the upper casing 28 via a damper 24*d*. The damper 24*d* and the lower end of the turning shaft 24*c* define the lower mount 79. Thus, the outboard motor body 21 is swingable with respect to the swivel bracket 24. As a result, a trim movement of the outboard motor body 21 can be accomplished.

Tilt and Trim Mechanism 30

Figure 3:
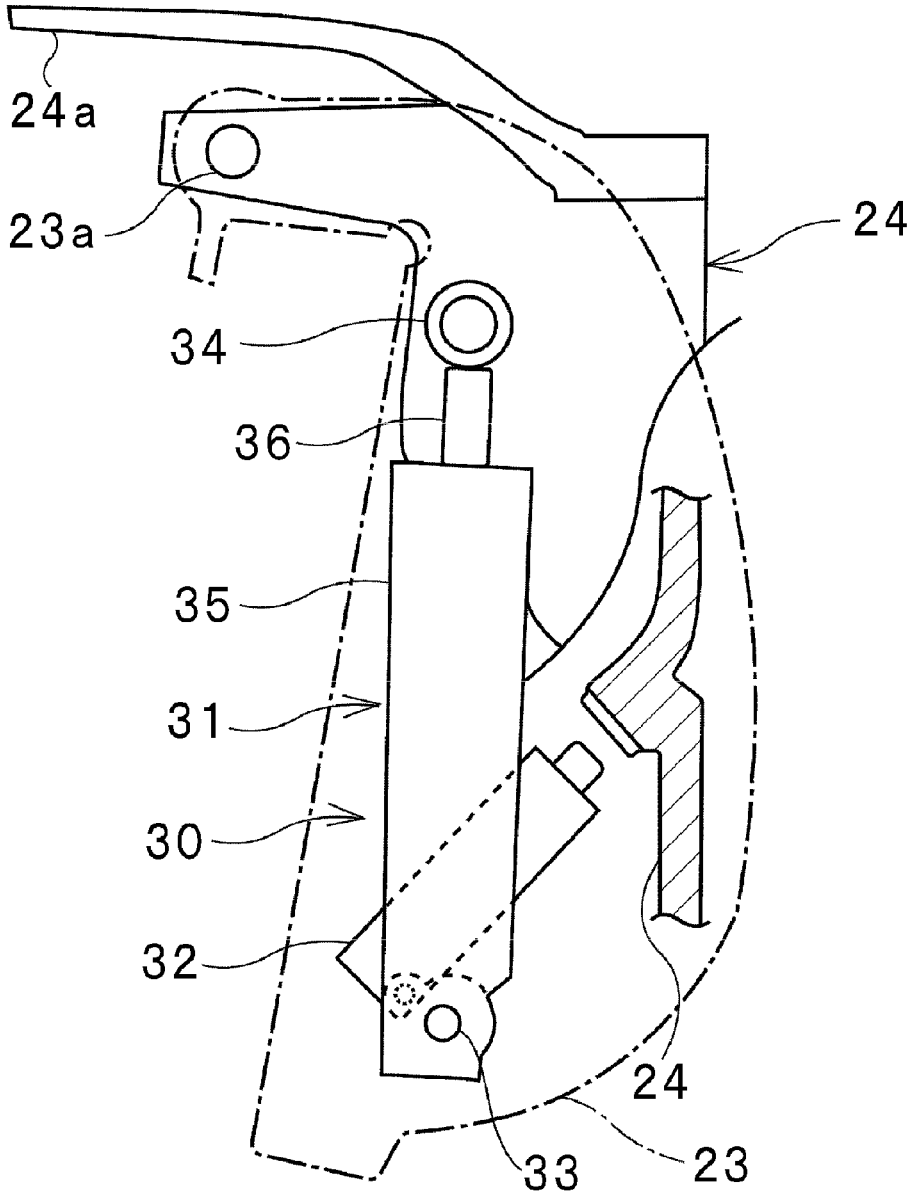
FIG. 3 is a side view of a tilt and trim mechanism.

The tilt and trim mechanism 30 is provided on the outboard motor 20. The tilt and trim mechanism 30 allows the outboard motor 20 to accomplish a tilt movement and the trim movement. Specifically, as shown in FIGS. 2 and 3, the tilt and trim mechanism 30 includes a hydraulic cylinder for tilt 31 and a hydraulic cylinder for trim 32. The hydraulic cylinder for tilt 31 relatively largely swings the swivel bracket 24 in the vertical direction around the axis of the turning shaft 23*a* with respect to the mount bracket 23. In contrast, the hydraulic cylinder for trim 32 relatively slightly swings the swivel bracket 24 in the vertical direction around the axis of the turning shaft 23*a* with respect to the mount bracket 23.

As shown in FIG. 3, the base end of the hydraulic cylinder for tilt 31 is mounted on a rotating shaft 33 fixed to the mount bracket 23 for free rotation. The base end of the hydraulic cylinder for trim 32 is also mounted on the rotating shaft 33 fixed to the mount bracket 23 without allowing rotation.

Figure 4:
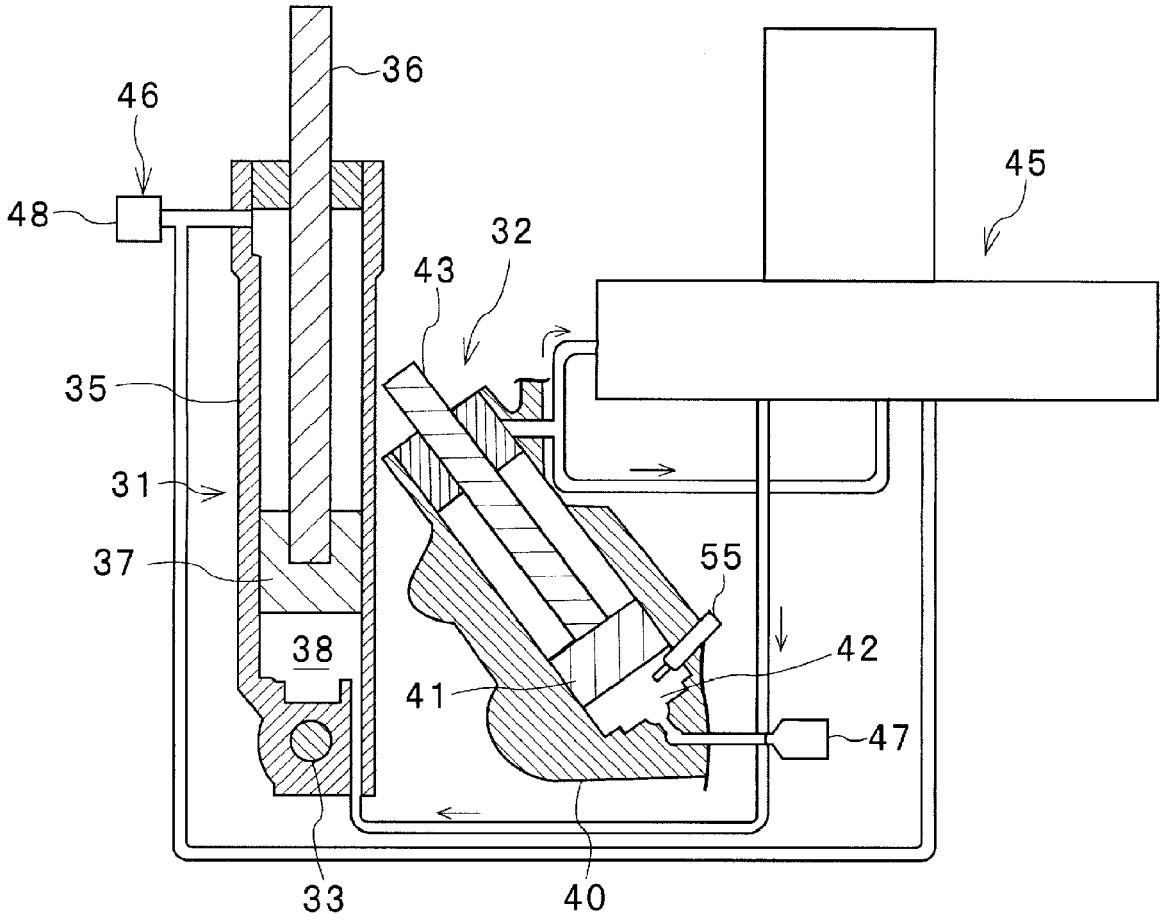
FIG. 4 is a conceptual view showing an oil circuit of the tilt and trim mechanism.

The hydraulic cylinder for tilt 31 includes, as shown in FIG. 4, a cylinder body 35 and a piston 37. A hydraulic chamber 38 is defined by the cylinder body 35 and the piston 37. The base end of a tilt ram 36 is connected to the piston 37. As shown in FIG. 3, a tip of the tilt ram 36 abuts on a sleeve 34 formed on the swivel bracket 24. With the expansion of the hydraulic cylinder for tilt 31, the tilt ram 36 presses upward the sleeve 34.

As shown in FIG. 4, the hydraulic cylinder for trim 32 includes a cylinder body 40 and a piston 41. A hydraulic chamber 42 is defined by the cylinder body 40 and the piston 41. The base end of a trim ram 43 is connected to the piston 41. As shown in FIG. 3, a tip of the trim ram 43 faces the swivel bracket 24. With the expansion of the hydraulic cylinder for trim 32, the trim ram 43 presses obliquely upward the swivel bracket 24 toward the rear.

An oil temperature sensor 55 is provided in the hydraulic chamber 42. The oil temperature sensor 55 detects an oil temperature in the hydraulic chamber 42 as a temperature of oil which circulates in the hydraulic chamber 42 and the hydraulic chamber 38.

As shown in FIG. 4, the hydraulic chamber 38 and the hydraulic chamber 42 are respectively connected to an oil pump 45. Pressures in the hydraulic chambers 38, 42 are increased by driving the oil pump 45. When the pressure in the hydraulic chamber 38 is increased, the piston 37 together with the tilt ram 36 are pushed out upward. Accordingly, the sleeve 34 shown in FIGS. 2 and 3 is pressed upward. As a result, the swivel bracket 24 together with the outboard motor body 21 rotate around the axis of the turning shaft 23*a* in an upward direction. In other words, the swivel bracket 24 together with the outboard motor body 21 are tilted up.

In contrast, when the pressure in the hydraulic chamber 38 is decreased, the hydraulic cylinder for tilt 31 contracts. As a result, the swivel bracket 24 together with the outboard motor body 21 rotate around the axis of the turning shaft 23*a* in a downward direction. In other words, the swivel bracket 24 together with the outboard motor body 21 are tilted down.

When the pressure in the hydraulic chamber 42 is increased, the hydraulic cylinder for trim 32 expands. Accordingly, the swivel bracket 24 is pressed obliquely upward toward the rear. As a result, the outboard motor body 21 is in a so-called trim-up state. In contrast, when the pressure in the hydraulic chamber 42 is decreased, the hydraulic cylinder for trim 32 contracts. As a result, the outboard motor body 21 is in a so-called trim-down state.

As shown in FIG. 4, a hydraulic pressure sensor 46 as a hydraulic pressure detection section is provided in the tilt and trim mechanism 30. The hydraulic pressure sensor 46 includes a forward thrust measuring hydraulic pressure sensor 47 and a reverse thrust measuring hydraulic pressure sensor 48.

The forward thrust measuring hydraulic pressure sensor 47 detects hydraulic pressure in the hydraulic chamber 42 in the hydraulic cylinder for trim 32. When the boat 1 is running forward, a forward thrust is produced by the propeller 54 shown in FIG. 2. Accordingly, an attractive force is generated between the swivel bracket 24 and the hull 10. Thus, the hydraulic cylinder for trim 32 receives a force which contracts the hydraulic cylinder for trim 32. As a result, the pressure in the hydraulic chamber 42 shown in FIG. 4 increases. That is, the pressure in the hydraulic chamber 42 correlates with the forward thrust. Therefore, the forward thrust is calculated from the pressure in the hydraulic chamber 42 detected by the forward thrust measuring hydraulic pressure sensor 47, which will be described in detail below.

The reverse thrust measuring hydraulic pressure sensor 48 detects hydraulic pressure in the hydraulic chamber 38 in the hydraulic cylinder for tilt 31. When the boat 1 is running in reverse, a reverse thrust is produced by the propeller 54 shown in FIG. 2. Accordingly, a repulsive force is generated in the direction that the outboard motor body 21 separates from the hull 10. Thus, the hydraulic cylinder for tilt 31 receives a force which expands the hydraulic cylinder for tilt 31. As a result, the pressure in the hydraulic chamber 38 shown in FIG. 4 decreases. That is, the pressure in the hydraulic chamber 38 correlates with the reverse thrust. Therefore, the reverse thrust is calculated from the pressure in the hydraulic chamber 38 detected by the reverse thrust measuring hydraulic pressure sensor 48, which will be described in detail below.

FIG. 4 is an oil circuit diagram illustrating connections of the hydraulic cylinder for tilt 31, the hydraulic cylinder for trim 32, and the oil pump 45. Arrangement of the hydraulic cylinder for tilt 31 and the hydraulic cylinder for trim 32 shown in FIG. 4 is a matter of convenience for description. The arrangement of the hydraulic cylinder for tilt 31 and the hydraulic cylinder for trim 32 shown in FIG. 4 may be different from the actual arrangement.

Outboard Motor Body 21

As shown in FIG. 2, the outboard motor body 21 includes a casing 25 and a thrust generating unit 50. The thrust generating unit 50 is housed in the casing 25 except for a portion of a propulsion section 57 which will be described below. The casing 25 includes an upper cowling 26, a lower cowling 27, an upper casing 28, and a lower casing 29.

The thrust generating unit 50 generates a thrust. The thrust generating unit 50 includes a power source 51, a power transmission mechanism 56, and the propulsion section 57. The propulsion section 57 includes a propeller shaft 53 and the propeller 54. The propeller 54 is connected to a tip of the propeller shaft 53. The power transmission mechanism 56 connects the power source 51 and the propulsion section 57. The power transmission mechanism 56 includes a shift mechanism 52.

The power source 51 generates a turning force as a driving force for the propeller 54. In this preferred embodiment, the power source 51 is preferably configured by an engine. However, the present invention does not limit the driving source 51 to an engine. For example, the driving source 51 may be an electric motor.

The shift mechanism 52 converts the turning force generated by the power source 51 into a forward or reverse turning force to transmit to the propeller shaft 53. Alternatively, the shift mechanism 52 disconnects a connection between the power source 51 and the propeller shaft 53. The shift mechanism 52 provides selection of shift positions between forward, neutral, and reverse.

The propulsion section 57 converts the turning force of the power source 51 into a thrust.

Control Block of Boat 1

Next, mainly referring to FIGS. 5 and 6, a control block of the boat 1 will be described.

Figure 5:
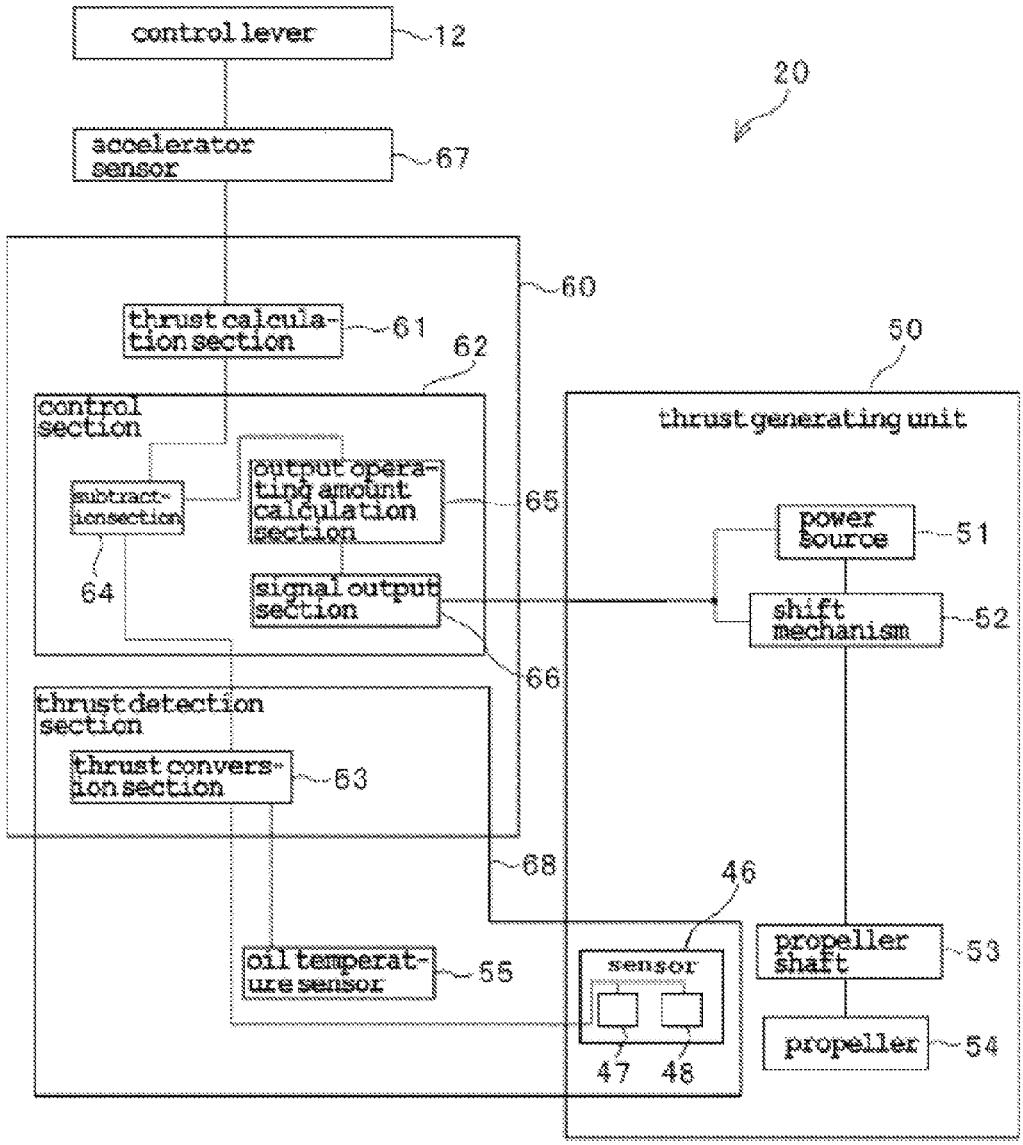
FIG. 5 is a control block diagram showing a control system in a first preferred embodiment of the present invention.

As shown in FIG. 5, the outboard motor 20 includes a control unit 60. In this preferred embodiment, the control unit 60 is preferably configured by an electronic control unit (ECU).

The control unit 60 includes a thrust calculation section 61, a control section 62, and a thrust conversion section 63. The thrust calculation section 61 is connected to an accelerator sensor 67 as an accelerator detector. The control section 62 includes a subtraction section 64, an output operating amount calculation section 65, and a signal output section 66. The thrust calculation section 61 is connected to the subtraction section 64. The subtraction section 64 is connected to the output operating amount calculation section 65. The output operating amount calculation section 65 is connected to the signal output section 66. The signal output section 66 is connected to the power source 51 and the shift mechanism 52.

The thrust conversion section 63 is connected to the hydraulic pressure sensor 46 and the oil temperature sensor 55. Specifically, the thrust conversion section 63 is connected to the forward thrust measuring hydraulic pressure sensor 47 and the reverse thrust measuring hydraulic pressure sensor 48. The thrust conversion section 63 is also connected to the subtraction section 64. The thrust conversion section 63, together with the hydraulic pressure sensor 46 as a hydraulic pressure detection section and the oil temperature sensor 55, defines a thrust detection section 68.

The thrust detection section 68 detects a thrust actually generated on the thrust generating unit 50. In particular, the thrust detection section 68 substantially precisely detects a thrust actually generated on the thrust generating unit 50. More specifically, as will be described below in detail, the thrust detection section 68 detects forces generated between the boat 1 and the outboard motor 20, or between the hull 10 and the outboard motor 20 by the thrust actually generated in the thrust generating unit 50. The thrust detection section 68 further detects forces generated by, or changed by, the above forces to calculate a thrust actually generated by such detected forces.

Figure 6:
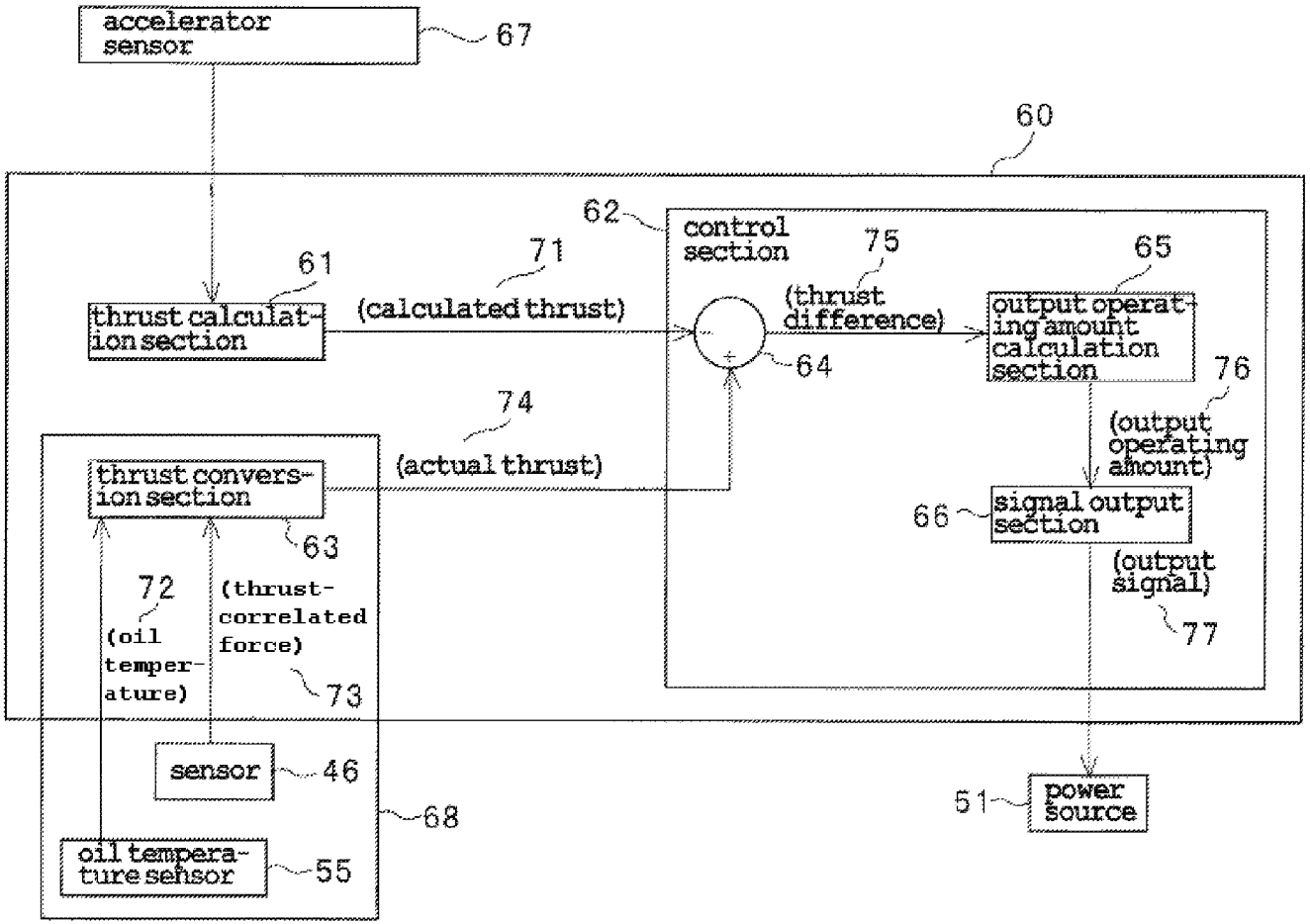
FIG. 6 is a control block diagram showing control in the first preferred embodiment of the present invention.

As shown in FIG. 6, the accelerator sensor 67 detects an operating amount input by the operator by detecting a position of the control lever 12. The accelerator sensor 67 outputs the operating amount to the thrust calculation section 61.

The thrust calculation section 61 calculates a thrust to be generated on the thrust generating unit 50 shown in FIG. 5 from the operating amount. The thrust calculation section 61 outputs the calculated thrust as a calculated thrust 71.

The hydraulic pressure sensor 46 detects the hydraulic pressure in the hydraulic chambers 38, 42 in the hydraulic cylinders 31, 32 shown in FIG. 4. The hydraulic pressure sensor 46 outputs the detected hydraulic pressure as a thrust-correlated force 73 to the thrust conversion section 63.

The oil temperature sensor 55 detects an oil temperature in the hydraulic chamber 42. The oil temperature sensor 55 outputs the detected temperature as an oil temperature 72.

The thrust conversion section 63 converts the thrust-correlated force 73 into an actual thrust generated on the thrust generating unit 50 shown in FIG. 5. The thrust conversion section 63 also compensates the converted thrust with the oil temperature 72. The thrust calculation section 63 outputs the compensated thrust as an actual thrust 74.

The subtraction section 64 subtracts the calculated thrust 71 from the actual thrust 74 to calculate a thrust difference 75. The subtraction section 64 outputs the thrust difference 75 to the output operating amount calculation section 65.

The output operating amount calculation section 65 calculates, from the thrust difference 75, an output operating amount 76 which is required to bring the actual thrust 74 near to the calculated thrust 71. In particular, the output operating amount calculation section 65 calculates the output operating amount 76 which is required to make the actual thrust 74 to be substantially equal to the calculated thrust 71. The output operating amount calculation section 65 outputs the output operating amount 76 to the signal output section 66.

The signal output section 66 generates an output signal 77 in response to the output operating amount 76. The signal output section 66 outputs the output signal 77 to the power source 51. Thus, the output of the power source 51 is adjusted.

The above calculations are repeated in the control unit 60 to thereby perform the output feedback control on the power source 51. As a result, the actual thrust 74 approaches the calculated thrust 71.

As described above, there are some cases in which, even if the rotational speed of the engine or the propeller is the same as the rotational speed corresponding to an operating amount of a control lever controlled by an operator, the actual thrust obtained by the boat propulsion system differs under different sea conditions. Accordingly, when the rotational speed of the engine or the propeller is controlled to follow the rotational speed corresponding to the operating amount of the control lever, the obtained thrust may differ for the same operating amount of the control lever. In other words, the obtained thrust may be different while the operating amount is the same. That is, a correlation between the operating amount and the actual obtained thrust may be changed by the sea conditions.

In contrast, in this preferred embodiment, the actual thrust 74 is detected. Then, the output of the thrust generating unit 50 is controlled so that the actual thrust 74 approaches the calculated thrust 71 calculated from the operating amount of the control lever. Therefore, even if the environment surrounding the boat 1 changes, the correlation between the operating amount of the control lever and the actual obtained thrust is resistant to change. That is, it is possible to stabilize the correlation between the operating amount of the control lever and the obtained thrust. In other words, it is possible to stabilize the correlation between the operating amount of the control lever 12 and the obtained thrust.

In particular, in this preferred embodiment, the actual thrust 74 is calculated based on the hydraulic pressure detected by the hydraulic pressure sensor 46. The hydraulic pressure varies in response to the thrust generated actually. Thus, the hydraulic pressure correlates with thrust generated actually regardless of the sea conditions. Therefore, it is possible to detect the actual thrust 74 precisely by calculating the actual thrust 74 based on the hydraulic pressure detected by the hydraulic pressure sensor 46.

Further, in this preferred embodiment, since the actual thrust is compensated with the oil temperature 72, it is possible to detect the actual thrust 74 more precisely.

As in this preferred embodiment, when the actual thrust 74 is detected by measuring the hydraulic pressure in the hydraulic chambers 38, 42, detection can be made by simply adding the hydraulic pressure sensor 46 to the hydraulic cylinders 31, 32. Therefore, it is not necessary to make a large-scale modification to the conventional outboard motor 20 to apply the present technique. It is relatively easy to equip the existing outboard motor 20 with the hydraulic pressure sensor 46. Thus, the present technique can be easily applied to the existing outboard motor 20.

In general, it is preferable that the output of the thrust generating unit 50 is controlled in the control section 62 so that the actual thrust 74 is adapted to be substantially equal to the calculated thrust 71. This allows an actual generated thrust to be closer to a thrust intended to be generated by the operator. Therefore, it is possible to further stabilize the correlation between the operating amount of the control lever 12 and an actual obtained thrust.

The present invention, however, is not limited to this control system and method. Depending on the characteristics of the boat 1 and the outboard motor 20, the output of the thrust generating unit 50 may be controlled so that the actual thrust 74 approaches the calculated thrust 71 to the extent that the actual thrust 74 is not substantially the same as the calculated thrust 71.

In this preferred embodiment, an example in which the forward thrust measuring hydraulic pressure sensor 47 and the reverse thrust measuring hydraulic pressure sensor 48 are separately provided is described. However, the present invention is not limited to this structure. For example, a single hydraulic pressure sensor for measuring both a forward thrust and a reverse thrust may be provided.

In this preferred embodiment, an example in which the forward thrust measuring hydraulic pressure sensor 47 is disposed in the hydraulic cylinder for trim 32 and the reverse thrust measuring hydraulic pressure sensor 48 is disposed in the hydraulic cylinder for tilt 31 is described. However, the present invention is not limited to this structure. For example, both the forward thrust measuring hydraulic pressure sensor 47 and the reverse thrust measuring hydraulic pressure sensor 48 may be disposed in either of the hydraulic cylinder for tilt 31 or the hydraulic cylinder for trim 32. Alternatively, the forward thrust measuring hydraulic pressure sensor 47 may be disposed in the hydraulic cylinder for tilt 31 while the reverse thrust measuring hydraulic pressure sensor 48 is disposed in the hydraulic cylinder for trim 32.

As shown in FIG. 6, in this preferred embodiment, an example in which the thrust difference 75 is calculated from the actual thrust 74 and the calculated thrust 71 is described. However, the present invention is not limited hereto. A thrust ratio may be calculated by dividing the actual thrust 74 by the calculated thrust 71 in the way that the thrust ratio is controlled to approach one (1).

In this preferred embodiment, an example in which hydraulic pressure detected by the hydraulic pressure sensor 46 is preferably used to calculate the actual thrust 74 is described. However, the present invention is not limited hereto. In other words, the thrust-correlated force 73 is not limited to the hydraulic pressure. The thrust-correlated force 73 is not specifically limited as long as it is a force generated between the boat 1 and the outboard motor 20 or between the hull 10 and the outboard motor 20 by the thrust actually generated on the thrust generating unit 50 or as long as it is a force generated or changed by such forces.

In the following second through fourth preferred embodiments, examples in which the thrust-correlated force 73 is based on data other than the hydraulic pressure are described. In the following description, FIGS. 1, 2, 4 to 6 are referenced. Elements having common functions with the first preferred embodiment will be referenced by common numerals and their description will be omitted.

Second Preferred Embodiment

Figure 7:
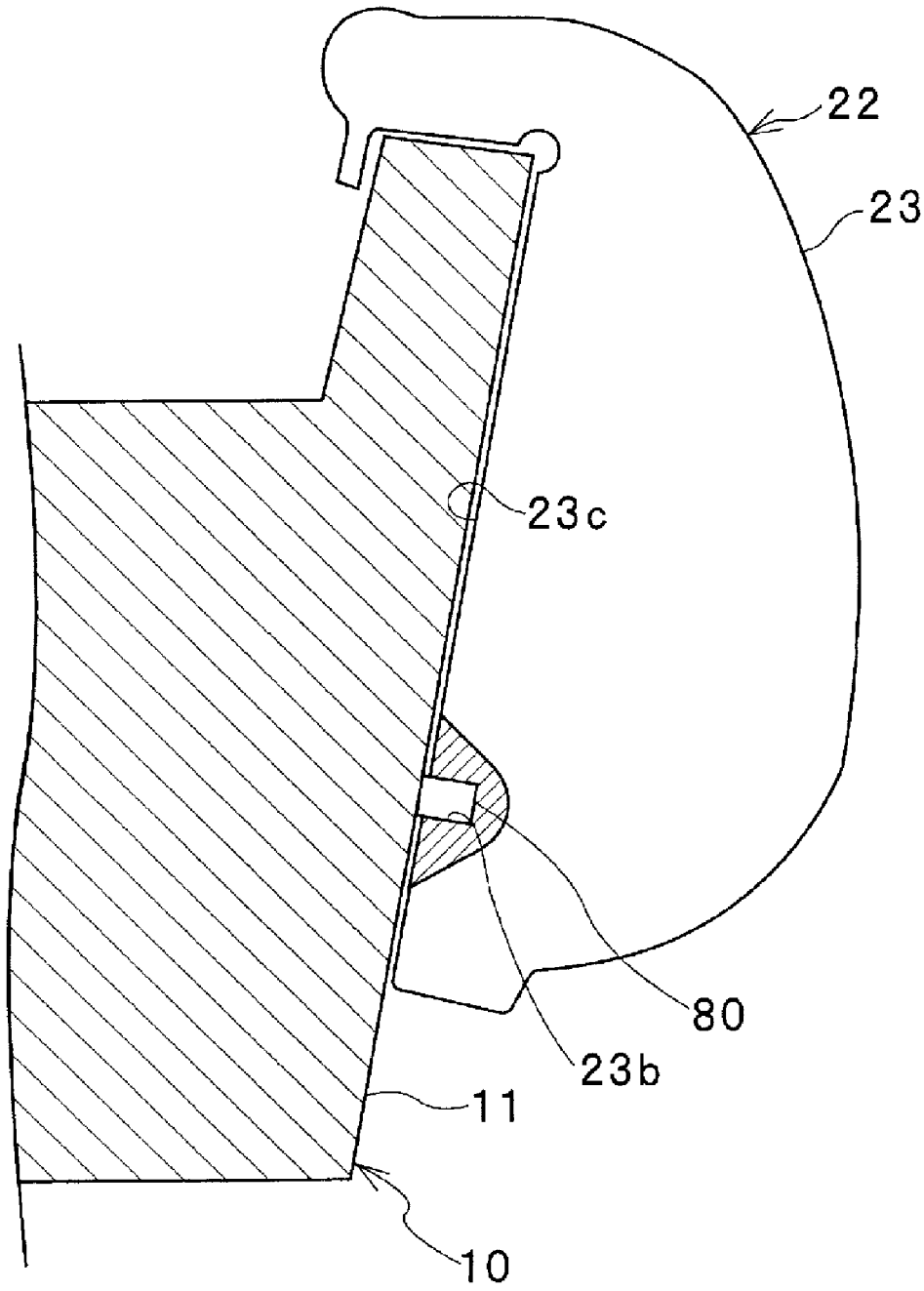
FIG. 7 is an enlarged partial sectional view of a mount bracket in a second preferred embodiment of the present invention.

FIG. 7 is an enlarged partial sectional view of the mount bracket 23 in this preferred embodiment. In this preferred embodiment, a pressure sensor 80 is provided instead of the hydraulic pressure sensor 46.

The pressure sensor 80 is disposed between the mount bracket 23 and the stern 11. In particular, a recess 23*b* is formed on a face 23*c* of the mount bracket 23, the surface 23*c* facing the stern 11. The pressure sensor 80 is disposed in the recess 23*b*. The tip of the pressure sensor 80 protrudes from the surface 23*c* toward the stern 11. By fixedly screwing the mount bracket 23 with a screw (not shown), for example, the pressure sensor 80 comes into pressed contact with the stern 11. A slight clearance is formed between the surface 23*c* of the mount bracket 23 and the stern 11. Accordingly, for example, when a fore-and-aft force is applied to the mount bracket 23, the mount bracket 23 moves slightly in the fore-and-aft direction with respect to the stern 11.

In this preferred embodiment, pressure between the stern 11 and the mount bracket 23 detected by the pressure sensor 80 is utilized as the thrust-correlated force 73 shown in FIG. 6.

When a forward thrust is generated on the thrust generating unit 50, the outboard motor 20 is pressed to the hull 10 via the mount bracket 23. Accordingly, the pressure detected by the pressure sensor 80 increases. In contrast, when a reverse thrust is generated on the thrust generating unit 50, a force is applied on the mount bracket 23 in a receding direction from the hull 10. Accordingly, the pressure detected by the pressure sensor 80 decreases. In this preferred embodiment, the thrust conversion section 63 calculates the actual thrust 74 by utilizing this phenomenon.

The method utilizing the pressure sensor 80 can easily be applied to an outboard motor not provided with the tilt and trim mechanism 30.

The pressure sensor 80 is not specifically limited to a certain type as long as it can measure pressure between the stern 11 and the mount bracket 23. For example, the pressure sensor 80 may be constituted by a magnetostrictive sensor or other suitable sensor element or device.

The pressure sensor 80 is only required to measure pressure when at least one of the stern 11 and the mount bracket 23 generates displacement with respect to the other caused by a force applied to the one of the stern 11 and the mount bracket 23. The pressure sensor 80 is not limited to a type that can only measure the pressure when the force is applied to both of the stern 11 and the mount bracket 23.

In this preferred embodiment, an example in which the pressure sensor 80 is fixed to the swivel bracket 24 is described. However, the pressure sensor 80 may be fixed to the stern 11 side.

Third Preferred Embodiment

Figure 8:
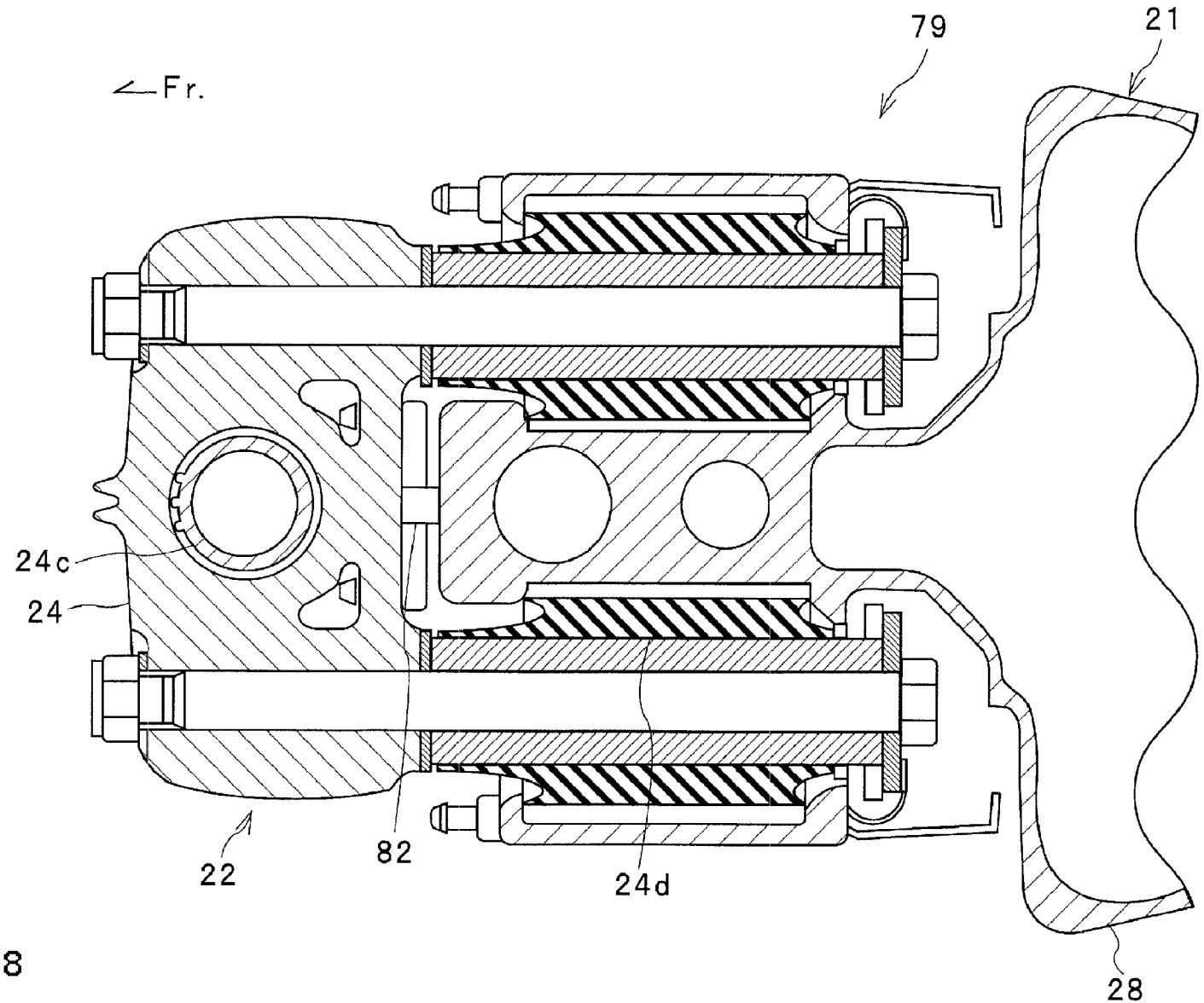
FIG. 8 is a sectional view of a lower mount in a third preferred embodiment of the present invention.

FIG. 8 is a sectional view of the lower mount 79 in this preferred embodiment. FIG. 8 is the sectional view of the portion taken along the cutout line VIII-VIII in FIG. 2.

In this preferred embodiment, an example in which a pressure sensor 82 is provided instead of the hydraulic pressure sensor 46 in the first preferred embodiment is described.

As shown in FIG. 8, in the swivel bracket 24, a damper 24*d* preferably of rubber and the like is fixedly provided. The upper casing 28 is fixed to the swivel bracket 24 via the damper 24*d* as an elastic member. Accordingly, the upper casing 28 is swingable in the fore-and-aft direction with respect to the swivel bracket 24.

The pressure sensor 82 is disposed between the swivel bracket 24 and the upper casing 28. The pressure sensor 82 is mounted on a surface of the swivel bracket 24 facing the upper casing 28. The pressure sensor 82 is disposed in generally parallel with an axis direction of the propeller shaft 53.

The pressure sensor 82 is disposed in pressed contact with the upper casing 28 under the condition that no force is applied between the swivel bracket 24 and the upper casing 28. When a forward thrust is generated on the thrust generating unit 50, the upper casing 28 is pressed to the swivel bracket 24 side. Accordingly, the pressure detected by the pressure sensor 82 increases. In contrast, when a reverse thrust is generated on the thrust generating unit 50, the upper casing 28 is pulled in a receding direction from the swivel bracket 24. Accordingly, the pressure detected by the pressure sensor 82 decreases. In this preferred embodiment, the thrust conversion section 63 calculates the actual thrust 74 by utilizing this phenomenon.

As described above, in this preferred embodiment, the actual thrust 74 is calculated from the pressure between the swivel bracket 24 and the upper casing 28. At this point, displacement of the upper casing 28 with respect to the swivel bracket 24 is relatively large. As a result, it is relatively easy to precisely measure the pressure between the swivel bracket 24 and the upper casing 28. Therefore, it is possible to detect the actual thrust 74 more precisely.

The lower mount 79 is arranged to define a substantially closed space by the swivel bracket 24 and the upper casing 28. Thus, it is possible to reduce influences from the sea water and the like exerted on the pressure sensor 82 by disposing the pressure sensor 82 in the lower mount 79. Therefore, disturbance in pressure detection of the pressure sensor 82 can be reduced. Also, deterioration of the pressure sensor 82 can be reduced.

In this preferred embodiment, the pressure sensor 82 preferably is disposed substantially parallel with the axis direction of the propeller shaft 53. A direction in which the pressure sensor 82 detects pressure generally coincides with the axis direction of the propeller shaft 53. Therefore, the pressure sensor 82 can detect the thrust more directly. For example, if the pressure detection direction inclines with respect to the axis direction of the propeller shaft 53, the detected pressure needs to be converted into the pressure in the axis direction of the propeller shaft 53. However, in this preferred embodiment as described above, it is not necessary to convert the detected pressure into the pressure in the axis direction of the propeller shaft 53.

The pressure sensor 82 is only required to measure pressure when at least one of the swivel bracket 24 and the upper casing 28 generates displacement with respect to the other caused by a force applied on the one of the swivel bracket 24 and the upper casing 28. The pressure sensor 82 is not limited to a type that can only measure the pressure when the force is applied to both of the swivel bracket 24 and the upper casing 28.

Fourth Preferred Embodiment

Figure 9:
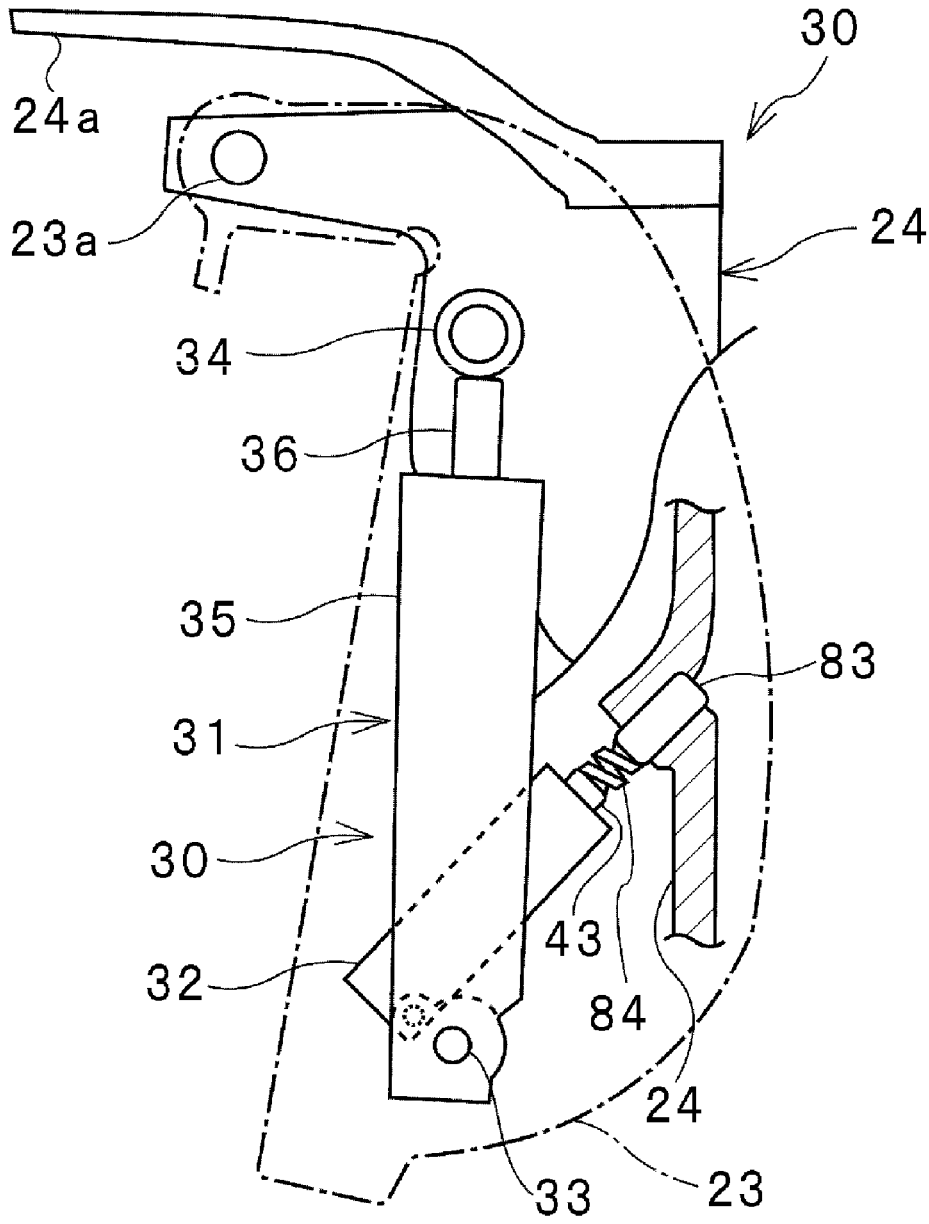
FIG. 9 is a side view of a tilt and trim mechanism in a fourth preferred embodiment of the present invention.

FIG. 9 is a side view of the tilt and trim mechanism 30 of a fourth preferred embodiment of the present invention.

In this preferred embodiment, a pressure sensor 83 is provided instead of the hydraulic pressure sensor 46 in the first preferred embodiment.

As shown in FIG. 9, the pressure sensor 83 is attached to the swivel bracket 24. One end of the pressure sensor 83 is connected to a tip of the trim ram 43 of the hydraulic cylinder for trim 32 via a compression coil spring 84 as another elastic member. Thus, when the forward thrust is generated on the thrust generating unit 50, the swivel bracket 24 is pressed to the mount bracket 23 side. Accordingly, the pressure detected by the pressure sensor 83 increases. In contrast, when a reverse thrust is generated on the thrust generating unit 50, the swivel bracket 24 is pulled in the receding direction from the mount bracket 23. Accordingly, the pressure detected by the pressure sensor 83 decreases. In this preferred embodiment, the thrust conversion section 63 calculates the actual thrust 74 by utilizing this phenomenon.

In the case that the actual thrust is detected by the pressure sensor 83 as in this preferred embodiment, such detection can easily be achieved on an outboard motor having the tilt and trim mechanism 30 only by adding the pressure sensor 83.

The pressure sensor 83 is only required to measure pressure when at least one of the mount bracket 23 and the swivel bracket 24 generates displacement with respect to the other caused by a force applied to the one of the mount bracket 23 and the swivel bracket 24. The pressure sensor 83 is not limited to a type that can only measure the pressure when the force is applied to both of the mount bracket 23 and the swivel bracket 24.

Fifth Preferred Embodiment

In the above first to fourth preferred embodiments, an example in which an outboard motor is preferably used as a boat propulsion system is described. However, in the present invention, the boat propulsion system is not limited to the outboard motor.

Figure 10:
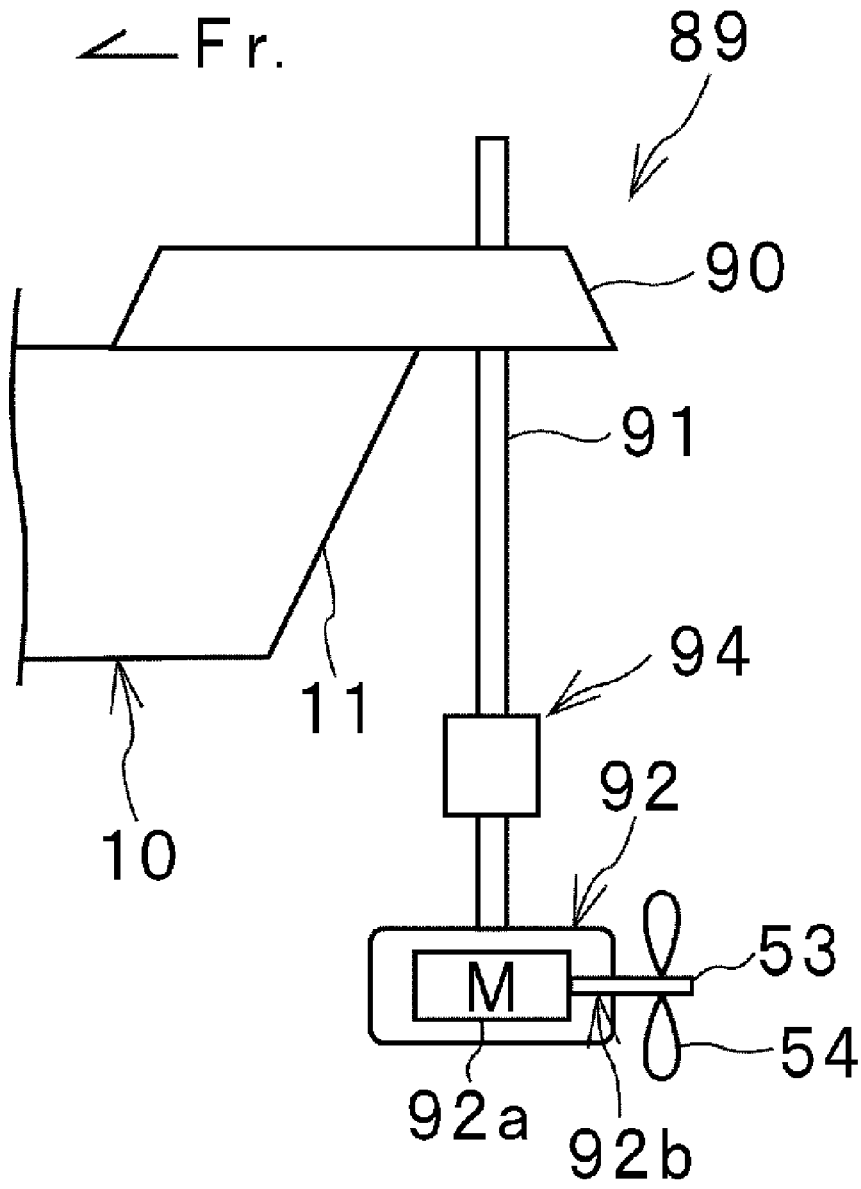
FIG. 10 is a schematic side view of the rear portion of a boat according to a fifth preferred embodiment of the present invention.

FIG. 10 is a schematic side view of the rear portion of a boat according to a fifth preferred embodiment. In this preferred embodiment, a boat propulsion system 89 is mounted at the stern 11.

In this preferred embodiment, an example in which the boat propulsion system 89 is mounted at the stern 11 will be described. However, mounting position of the boat propulsion system 89 is not limited to the stern 11. The boat propulsion system 89 may be mounted at any portion on the hull 10.

The boat propulsion system 89 includes a fixing member 90, a support bar 91, and a thrust generating unit 92. The fixing member 90 is fixed to the stern 11. An upper end of the support bar 91 is supported by the fixing member 90. On the other hand, at a lower end of the support bar 91, the thrust generating unit 92 is fixed.

The thrust generating unit 92 includes an electric motor 92*a* as a power source and a propulsion section 92*b*. The propulsion section 92*b* includes the propeller shaft 53 and the propeller 54.

A detection section 94 is attached to the support bar 91. The detection section 94 detects a force applied to the support bar 91. In this preferred embodiment, the actual thrust 74 is calculated based on the force detected by the detection section 94.

Figure 11:
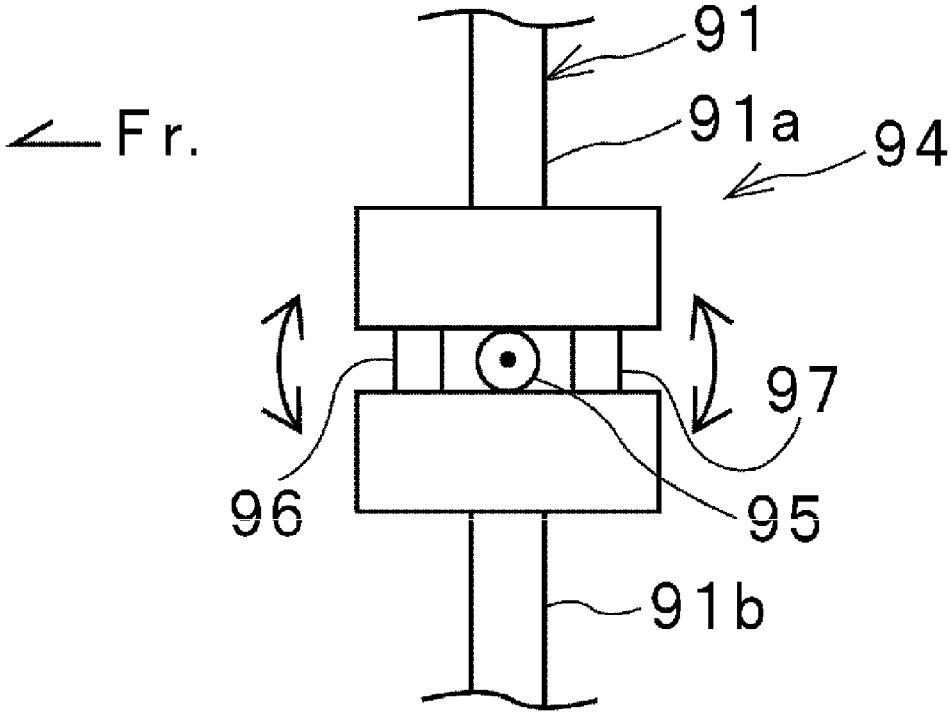
FIG. 11 is a schematic side view showing a construction of a thrust detection section in the fifth preferred embodiment of the present invention.

In particular, as shown in FIG. 11, the support bar 91 includes a first support bar 91*a*, a second support bar 91*b*, and a hinge member 95. The first support bar 91*a* and the second support bar 91*b* are connected to be swingable in the fore-and-aft direction by the hinge member 95. A first pressure detection section 96 is disposed between the first support bar 91*a* and the second support bar 91*b* and in front of the hinge member 95. In contrast, a second pressure detection section 97 is disposed between the first support bar 91*a* and the second support bar 91*b* and in the rear of the hinge member 95. The first pressure detection section 96 and the second pressure detection section 97 may be constituted, for example, by a load cell.

When a forward thrust is generated on the thrust generating unit 50, a force directed forward is applied to the lower end of the support bar 91. Accordingly, the pressure detected by the first pressure detection section 96 increases. In contrast, when a reverse thrust is generated on the thrust generating unit 92, a force directed rearward is applied to the lower end of the support bar 91. Accordingly, the pressure detected by the second pressure detection section 97 increases. In this preferred embodiment, the thrust conversion section 63 calculates the actual thrust 74 by utilizing this phenomenon.

In this preferred embodiment, an actual generated thrust can also be made closer to a thrust intended to be generated by the operator as in the first preferred embodiment. Thus, the high controllability of the outboard motor 20 can be achieved.

Variations of Preferred Embodiments

Figure 12:
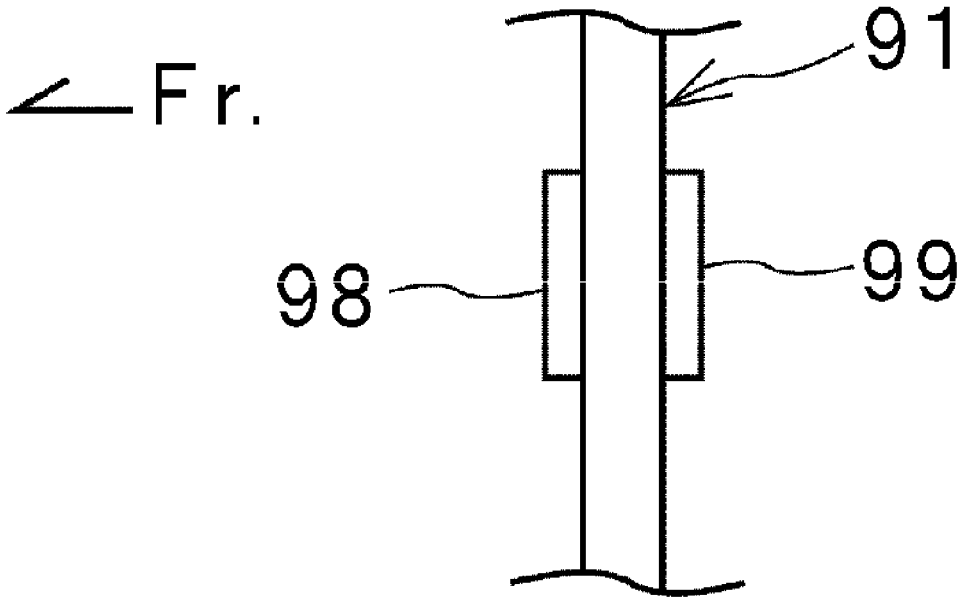
FIG. 12 is a schematic side view showing a variation of a construction of a thrust detection section.

FIG. 12 is a schematic side view showing a construction of a thrust detection section in a variation. In the above fifth preferred embodiment, an example in which a force applied to the support bar 91 is detected by the two pressure detection sections 96, 97 is described. However, the present invention is not limited to this structure. As shown in FIG. 12, the force applied to the support bar 91 may be detected by strain detection sections 98, 99 respectively attached to a front surface and a rear surface, respectively, of the support bar 91.

Further, in the fifth preferred embodiment, an example in which the electric motor 92*a* as a power source is supported at the lower portion of the support bar 91 and positioned underwater during operation of the boat is described. However, the electric motor 92*a* is not limited to be positioned underwater. The electric motor 92*a* may be positioned, for example, on the hull 10.

Further, the electric motor 92*a* may be replaced with an engine.

Sixth Preferred Embodiment

Figure 13:
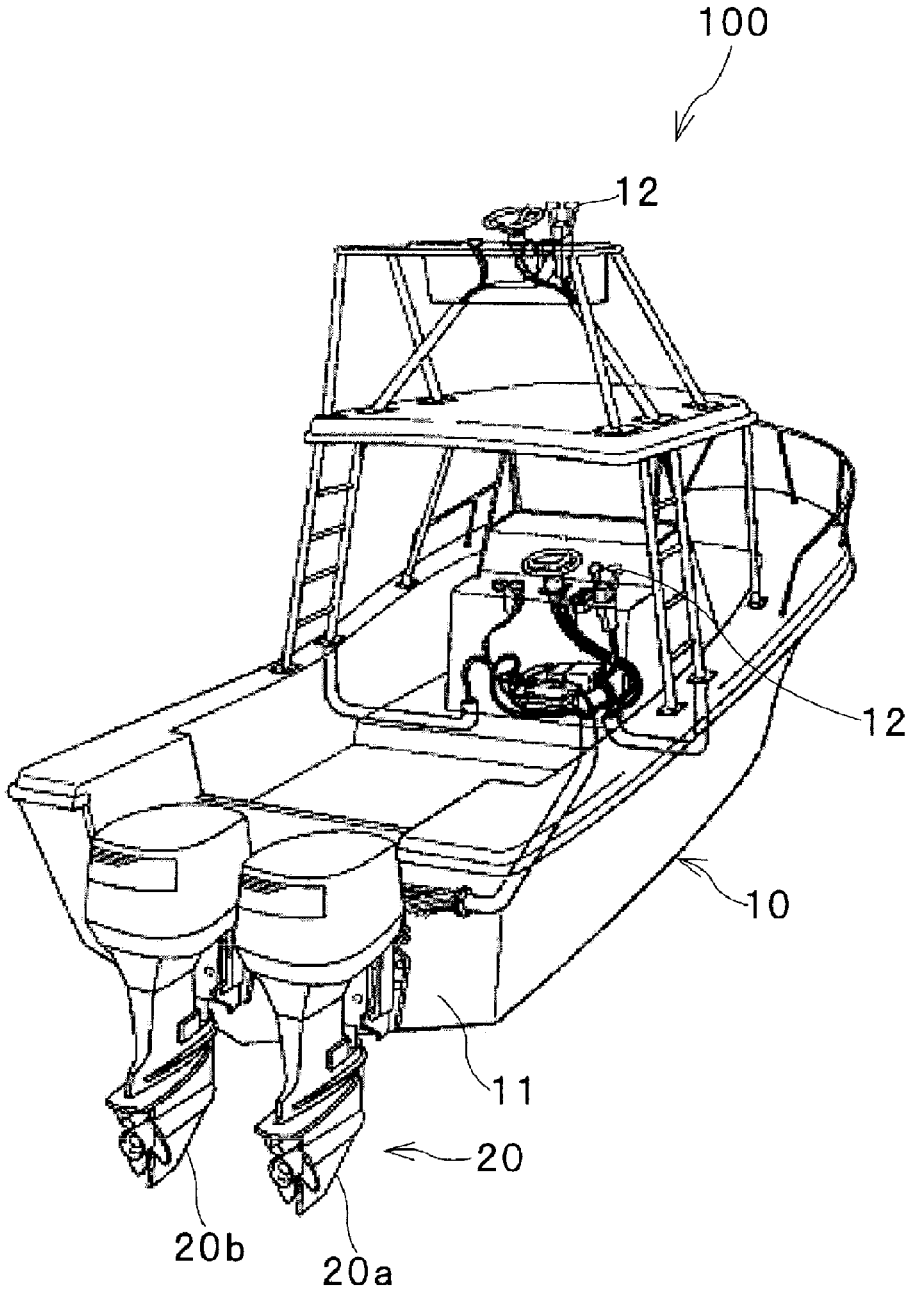
FIG. 13 is a perspective view from rearward of a boat according to a sixth preferred embodiment of the present invention.
Figure 14:
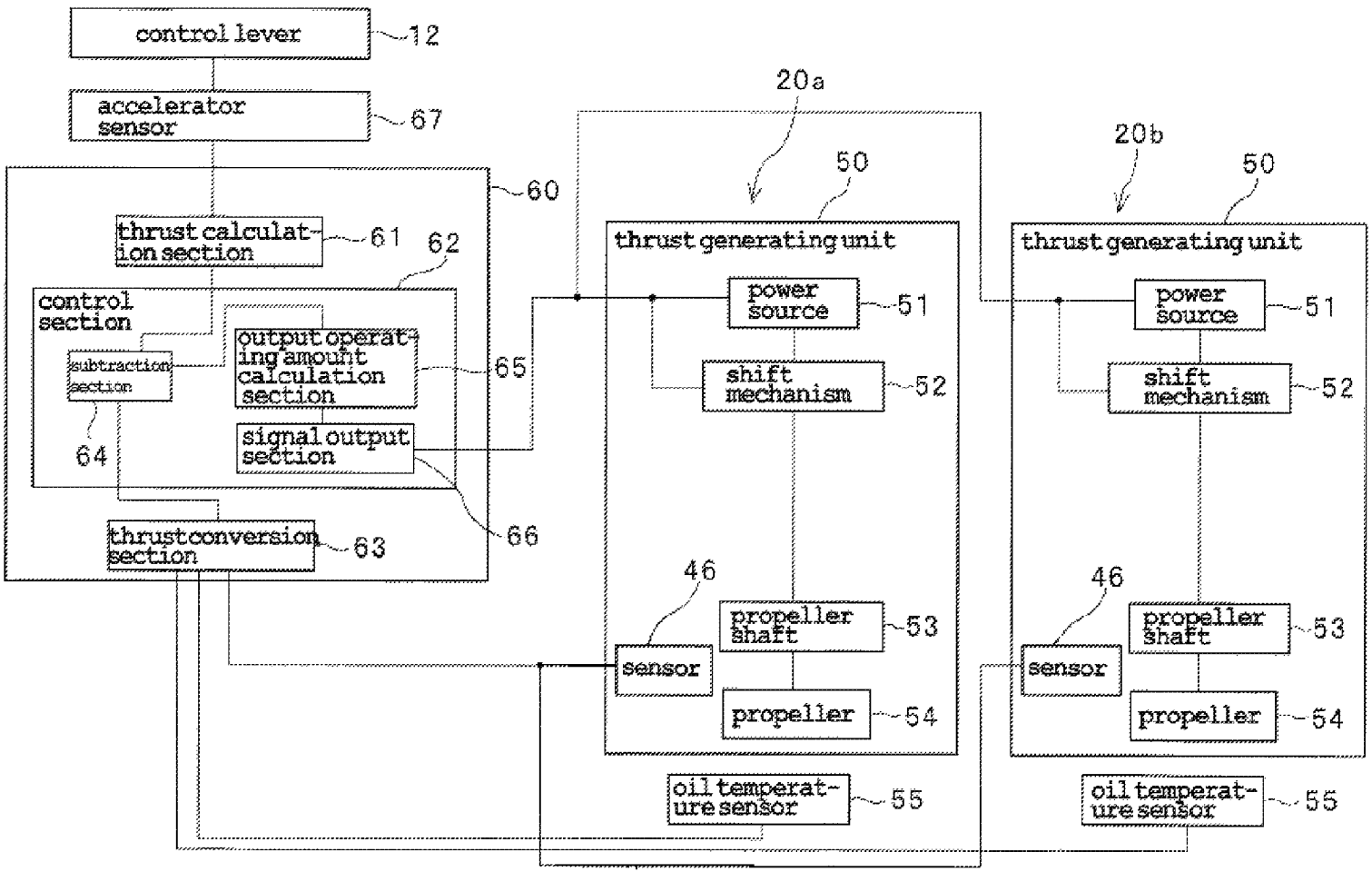
FIG. 14 is a control block diagram showing a control system in the sixth preferred embodiment of the present invention.

FIG. 13 is a perspective view from rearward of a boat 100 according to a sixth preferred embodiment. FIG. 14 is a control block diagram showing a control system in a sixth preferred embodiment. In the first preferred embodiment, an example in which the boat 1 has the single outboard motor 20 is described. However, the present invention is not limited to this structure. The present invention may be applied to a boat having a plurality of boat propulsion systems.

As shown in FIG. 13, the boat 100 according to the sixth preferred embodiment includes two outboard motors 20. In particular, the boat 100 includes an outboard motor 20*a*, an outboard motor 20*b*, and a control unit 60. In this preferred embodiment, the outputs of the thrust generating units 50 are also controlled so that the actual thrust 74 approaches the calculated thrusts 71 for each of the outboard motor 20*a* and the outboard motor 20*b*, as in the first preferred embodiment. This allows an actual generated thrust to be closer to a thrust intended to be generated by the operator. Therefore, it is possible to stabilize the correlation between the operating amount of the control lever 12 and an actual obtained thrust.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A boat propulsion system comprising:
- a control lever operated by an operator;
- an accelerator detector that detects a position of the control lever;
- a thrust calculation section that calculates a thrust corresponding to the position of the control lever detected by the accelerator detector and that outputs a calculated thrust;
- a thrust generating unit that generates a thrust;
- a thrust detection section that detects the thrust actually generated on the thrust generating unit and to output an actual thrust; and
- a control section that controls the thrust generating unit so that the actual thrust approaches the calculated thrust.

2. The boat propulsion system according to claim 1, wherein the control section controls the thrust generating unit so that the actual thrust becomes substantially equal to the calculated thrust.

3. The boat propulsion system according to claim 1, wherein the thrust detection section detects both a forward thrust and a reverse thrust.

4. The boat propulsion system according to claim 1, wherein the boat propulsion system is an outboard motor.

5. The boat propulsion system according to claim 4, further comprising:
- a mount bracket fixed to a hull;
- a swivel bracket swingably supported by the mount bracket in a vertical direction around a swing axis;
- a propulsion unit mounted on the swivel bracket, the propulsion unit including the thrust generating unit; and
- a hydraulic cylinder disposed between the mount bracket and the swivel bracket and arranged to swing the swivel bracket with respect to the mount bracket; wherein
- the thrust detection section includes:
  - a hydraulic pressure detection section that detects hydraulic pressure in the hydraulic cylinder; and
  - a thrust conversion section that calculates the actual thrust based on the hydraulic pressure detected by the hydraulic pressure detection section.

6. The boat propulsion system according to claim 4, further comprising:
- a bracket fixed to a hull; and
- a propulsion unit mounted on the bracket, the propulsion unit including the thrust generating unit; wherein
- the thrust detection section includes:
  - a pressure detection section disposed between the bracket and the hull that detects pressure exerted by both the bracket and the hull; and
  - a thrust conversion section that calculates the actual thrust based on the pressure detected by the pressure detection section.

7. The boat propulsion system according to claim 4, further comprising:
- a bracket fixed to a hull;
- an elastic member fixed to the bracket; and
- a propulsion unit mounted on the bracket via the elastic member, the propulsion unit including the thrust generating unit; wherein
- the thrust detection section includes:
  - a pressure detection section disposed between the bracket and the propulsion unit that detects pressure exerted by both the bracket and the propulsion unit; and
  - a thrust conversion section that calculates the actual thrust based on the pressure detected by the pressure detection section.

8. The boat propulsion system according to claim 4, further comprising:
- a bracket fixed to a hull;
- an elastic member fixed to the bracket;
- a propulsion unit mounted on the bracket via the elastic member, the propulsion unit including the thrust generating unit;
- a hydraulic cylinder disposed between the bracket and the propulsion unit arranged to swing the propulsion unit with respect to the bracket; and
- another elastic member disposed between the hydraulic cylinder and the propulsion unit; wherein
- the thrust detection section includes:
  - a pressure detection section disposed between the propulsion unit and said another elastic member; and
  - a thrust conversion section that calculates the actual thrust based on the pressure detected by the pressure detection section.

9. The boat propulsion system according to claim 6, wherein the propulsion unit includes:
- a power source that generates power;
- a propeller shaft rotated by the power generated by the power source; and
- a propeller attached to the propeller shaft and arranged to rotate with the propeller shaft; wherein
- a pressure detection direction of the pressure sensor generally coincides with an axis direction of the propeller shaft.

10. The boat propulsion system according to claim 1, wherein the thrust generating unit includes:
- a driving source that generates power; and
- a propulsion section that converts power generated by the power source into a thrust, the propulsion section including a propeller shaft rotated by the power generated on the power source and a propeller arranged to rotate with the propeller shaft; wherein the boat propulsion system further includes:
- a support bar to which the propulsion section is fixed; and
- a fixing member that supports the support bar on the hull.

11. The boat propulsion system according to claim 10, wherein the thrust detection section includes:
- a detection section that detects a force applied to the support bar; and
- a thrust conversion section that calculates the actual thrust based on the force detected by the detection section.

12. The boat propulsion system according to claim 11, wherein the detection section is attached to the support bar and includes a strain detection section that detects strain produced on the support bar.

13. The boat propulsion system according to claim 12, wherein the support bar includes a first support bar having one end attached to the fixing member, a second support bar having one end attached to the propulsion section, and a hinge member arranged to swingably connect another end of the first support bar and another end of the second support bar in the fore-and-aft direction, and the detection section includes a pressure detection section disposed between the first support bar and the second support bar that detects pressure exerted by both the first support bar and the second support bar.

14. A boat comprising the boat propulsion system according to claim 1.

15. The boat according to claim 14, further comprising a plurality of the boat propulsion systems.

16. A boat control device comprising:

a control lever operated by an operator;

an accelerator detector that detects a position of the control lever; and a plurality of boat propulsion systems each including a thrust generating unit that generates a thrust and a detection section that detects a thrust-correlated force actually generated on the thrust generating unit, each of the plurality of boat propulsion systems including:

a thrust calculation section that calculates a thrust generated on the boat propulsion system corresponding to the position of the control lever detected by the accelerator detector and to output a calculated thrust of the boat propulsion system;

a thrust conversion section that calculates a thrust actually generated on each boat propulsion system based on the thrust-correlated force and that outputs an actual thrust of the boat propulsion system; and a control section that controls the thrust generating unit of each boat propulsion system so that the actual thrust approaches the calculated thrust.

17. A boat control method comprising the steps of:

providing a control lever operated by an operator, an accelerator detector that detects a position of the control lever, and a plurality of boat propulsion systems each including a thrust generating unit and a thrust detection section that detects a thrust-correlated force actually generated on the thrust generating unit;

calculating a thrust generated on each of the plurality of boat propulsion systems based on the position of the control lever detected by the accelerator detector;

calculating an actual thrust actually generated on each of the plurality of boat propulsion systems based on the thrust-correlated force; and controlling the thrust generating unit of each of the boat propulsion systems so that the actual thrust approaches the calculated thrust.

* * * * *